United States Patent [19]

St. Louis

[11] Patent Number: 4,586,269

[45] Date of Patent: May 6, 1986

[54] DRIER BEARING

[75] Inventor: Robert M. St. Louis, St. Leonard, Canada

[73] Assignee: Camco Inc., Mississauga, Canada

[21] Appl. No.: 729,043

[22] Filed: Apr. 30, 1985

[30] Foreign Application Priority Data

Nov. 16, 1984 [CA] Canada ..... 468023

[51] Int. Cl.[4] ..... F26B 11/00

[52] U.S. Cl. ..... 34/133; 34/242

[58] Field of Search ..... 34/130, 133, 242, 243 R

[56] References Cited

U.S. PATENT DOCUMENTS 3,483,632 12/1969 Triplett ..... 34/133
4,430,089 2/1984 Jackson et al. ..... 34/133
4,516,335 5/1985 Aoki et al. ..... 34/133

FOREIGN PATENT DOCUMENTS 628464 10/1961 Canada .
787074 6/1968 Canada .

*Primary Examiner*—Albert J. Makay
*Assistant Examiner*—David W. Westphal
*Attorney, Agent, or Firm*—Raymond A. Eckersley

[57] ABSTRACT

A drier drum bearing structure formed from a single piece of molded plastic to provide a right cylindrical outer bearing wall. The bearing structure is mounted on a non-circular access opening through the drier cabinet wall on a peripheral flange extending around the opening on the wall which is received within a mounting cavity formed in part between the outer cylindrical bearing surface and an inner wall and is held in position by means of bosses on the bearing structure cooperating with mating bosses on the peripheral flange to permit movement circumferentially about the access opening while substantially preventing axial movement.

9 Claims, 12 Drawing Figures

FIG. 7.
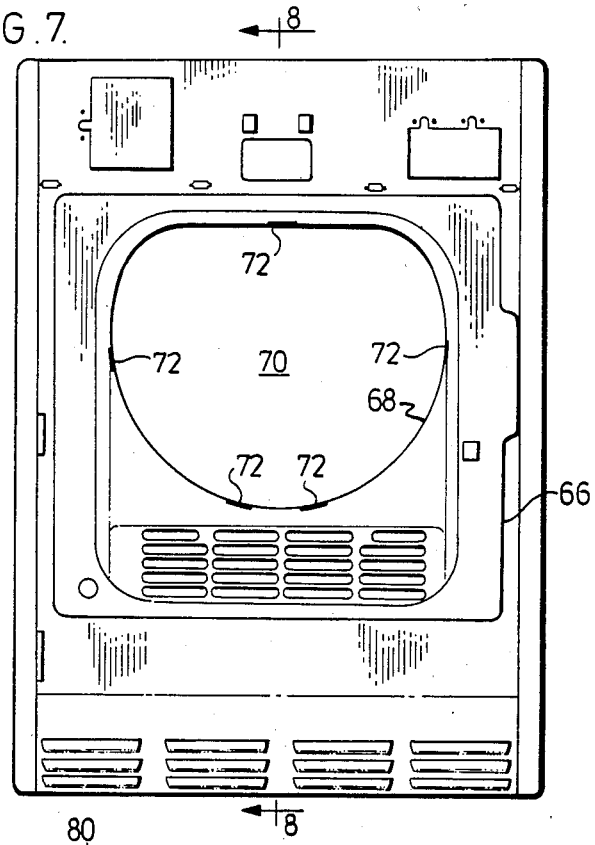
FIG. 8
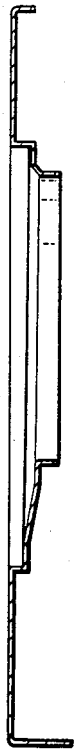
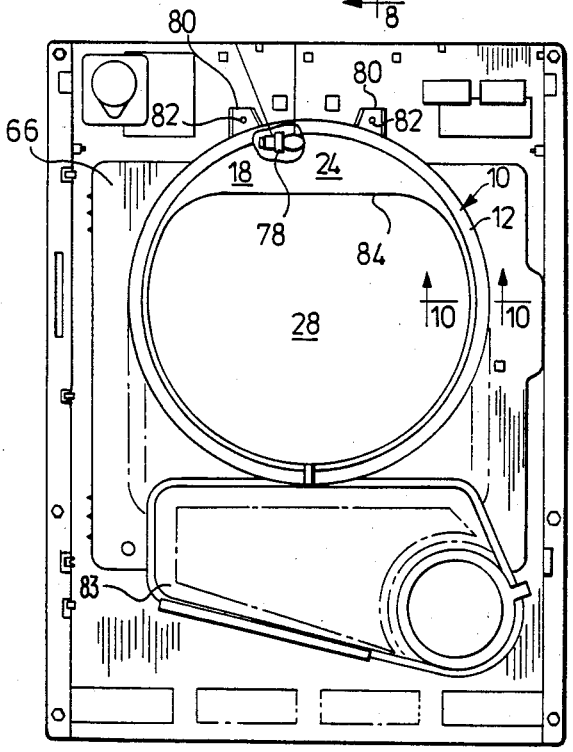
FIG. 9.
FIG. 10.
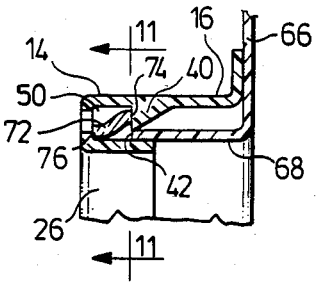
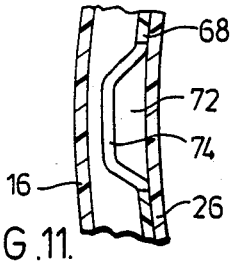
FIG. 11.

DRIER BEARING

FIELD OF THE INVENTION

The present invention relates to a clothes drier structure. More particularly the present invention relates to a front bearing structure mounted on a non-circular access opening of the cabinet while supporting the rotating drum on a cylindrical bearing surface fitting within the access opening to the drum.

BACKGROUND TO THE PRESENT INVENTION

Various bearing structures have been used to support the rotating drier drum within the cabinet of a drier. Such support may take the form of a substantially axial shaft extending from the closed end of the drum and received in suitable bearing. More generally there are bearings on both ends of the drum and in some cases the bearing structure at the open end of the drum is formed within the access opening of the drum. See for example Canadian Pat. No. 787,074, issued June 11, 1968, to Whistler.

It is also known to mount the front end of the drum on rollers which contact the outside of the flange around the access opening of the drier drum as shown for example in Canadian Pat. No 628,464, issued Oct. 3, 1961 to Shapter.

Particular attention is directed to U.S. Pat. No. 4,430,089, issued Feb. 14, 1984 to Jackson which discloses a drier structure wherein the access opening through the cabinet is non-circular and a bearing structure is provided together with a seal that is mounted in part on the inside rim of the access opening of the drum with a cooperating part mounted on the flange surrounding the access opening through the cabinet wall. The particular bearing structure disclosed is a three part structure, one of the parts being formed by securing together a plurality of metal elements. This device provides a means whereby the access opening through the front wall of the drier may be non-circular yet the drier drum bearing may be provided mounted around this opening and in a position to cooperate with a bearing mounted on and conforming with the inner rim of the access opening to the drum.

The structure disclosed in this U.S. Pat. No. 4,430,809, is relatively expensive and requires the use of a plurality of different elements all of which must be fabricated and then secured in position by suitable means such as welding or by tabs, etc. The patent does disclose means for accommodating differential expansion between a plastic bearing insert and the metal of the drum and cabinet by providing a slip joint between the bearing and the drum itself.

BRIEF DESCRIPTION OF THE PRESENT INVENTION

It is an object of the present invention to provide a relatively inexpensive one piece molded bearing structure that may be mounted directly to the front access wall of the drier cabinet and accommodate non-circular access opening in the cabinet while providing a substantially cylindrical bearing section.

The bearing structure of the present invention is also effective regardless of the orientation of the drier i.e., right side up, up side down or on its side.

Broadly the present invention comprises a drier drum bearing member having an outer substantially right cylindrical wall forming a bearing adapted to be received in an access opening in a drier drum structure and to cooperate with the inner rim of the access opening to form a bearing for the drum, a non-circular inner wall substantially parallel to said outer wall and defining a non-circular opening corresponding to an access opening to be provided in a wall of the drier cabinet, a facing wall interconnecting said inner and outer walls, said inner walls being positioned immediately adjacent said outer wall over a major portion of the periphery of said non-circular opening through said bearing member to form a first portion of a mounting cavity between said inner and outer wall, a joining wall substantially parallel to said inner wall in position to combine with said inner wall to form a second portion of said mounting cavity with first and second portions extending substantially 360° around said access opening in said mounting member, spaced bosses extending from a wall of said cavity toward an opposite wall of said cavity, at least some of said bosses having abutment edges substantially perpendicular to said inner wall and spaced from said facing wall to provide a free space between said abutment edge and said facing wall to receive a mating structure on said cabinet therebetween.

Preferably the first portion of said cavity will be substantially right cylindrical in shape and preferably said outer, inner and facing walls will terminate in said first portion of said cavity to provide spaced edges of said walls spaced circumferentially of said access opening sufficiently to accommodate thermal expansion of said bearing member.

Preferably the facing wall between the joining wall and the outer wall will transmit light and will form a portion of a cavity for mounting a suitable light bulb.

Only certain of the spaced bosses need be provided with abutment edges with the others extending to the bottom of the cavity formed by the facing wall.

Preferably the access opening on the wall of the drier drum cabinet will be formed with a peripheral flange that is received within the cavity and is provided with spaced abutment edges pressed from the flange and extending substantially circumferentially of the flange in a radial plane in a position to come in face to face contact with said abutment edges on the bearing member when the bearing member is mounted on said peripheral flange to prevent axial movement relative to said access opening while permitting circumferential expansion of the bearing member without disengagement of the abutment edges.

The spacing between the edge of each boss and the said opposite wall of the cavity from which the bosses extend is substantially equal to the thickness of said flange, whereby said flange is resiliently gripped between said edges and said opposite wall to prevent radial movement of said bearing member relative to said peripheral flange.

Preferably the bosses will extend from said outer wall and said joining wall toward said inner wall.

Further features, objects and advantages will be evident from the following detailed description of the preferred embodiments of the present invention taken in conjunction with the accompanying drawings in which:

FIG. 7 is a elevation view of a front panel with which the present invention may be used;

FIG. 8 is a section along the line 8—8 of FIG. 7;

FIG. 9 is a view similar to FIG. 7, but on a reduced scale and showing the bearing, and some of the ducting in position and with parts broken away to illustrate the lighting arrangement;

FIG. 10 is a view similar to FIG. 4 but showing the bearing mounted in position on the front wall;

FIG. 11 is a section along the line 11—11 of FIG. 10.

DESCRIPTION OF THE PREFERRED EMBODIMENTS

Figure 1:
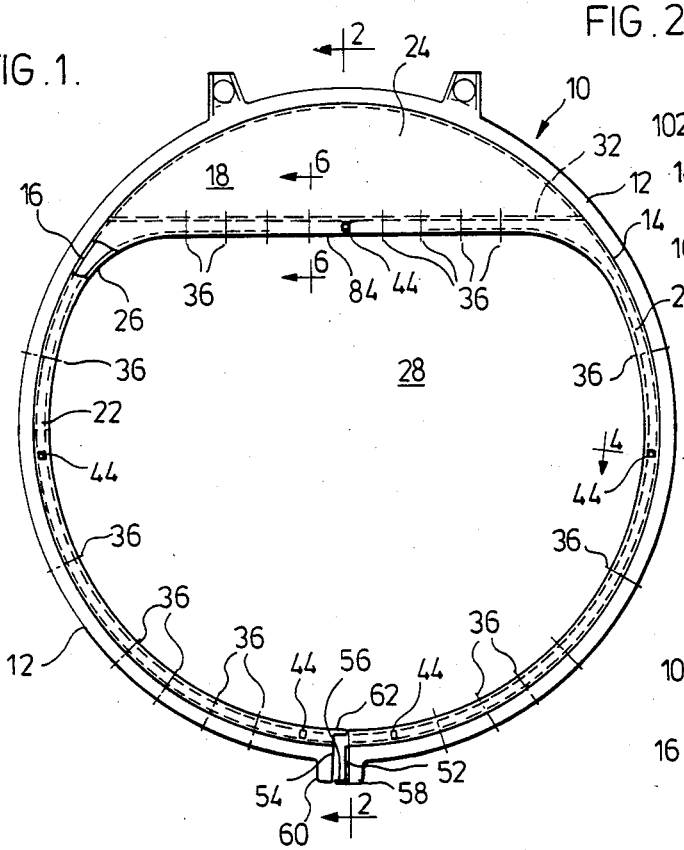
FIG. 1 is an elevation view of a one piece molded bearing structure constructed in accordance with the present invention as removed from the mold.

The bearing member 10 may be formed for example by injection molding of a suitable plastic material such as nylon or the like into a suitable mold. The member 10 as illustrated is formed with a radially extending circumferential flange 12 surrounding a circumferential bearing surface 14 formed by the outer surface of an outer wall 16 of the bearing member 10. In operative position the bearing surface 14 will be substantially right cylindrical. Connected to and extending perpendicular from the outer wall 16 at the end thereof remote from the flange 12 is a facing wall 18 which has a pair of substantially semi-circular relatively narrow arms 20 and 22 extending from a main D-shaped section 24 that is substantially translucent and provides a cover for a light as will be described hereinbelow.

An inner wall 26 extends substantially perpendicular from the facing wall 18, i.e., parallel to the outer wall 16 along each of the narrow arms 20 and 22 and across the end of the D-shaped section 24. This inner wall 26 defines the outer periphery of a non-circular access opening 28 through the bearing member.

It will be noted that the walls 16 and 26 combine with the arms 20 and 22 of the facing wall 18 to define a first portion of a cavity 30 extending part way around the access opening 28. In the D-shaped section a joining wall 32 is provided extending substantially as a cord interconnecting spaced points on the outer wall 16. This joining wall 32 cooperates with the adjacent portion of the inner wall 26 and the facing wall 18 to form a second portion of and to complete the cavity 30.

Positioned at spaced locations around the cavity 30 are a plurality of bosses 34. Such bosses will be positioned, for example as shown at locations designated as 36 in FIG. 1 there being 8 such bosses spaced along the second portion of the cavity 30 and bosses at the 2:00, 4:00, 4:45, 5:00, 5:15, 5:30, 6:30, 6:45, 7:00, 7:15, 8:00 and 10:00 o'clock positions around the first portion of the cavity.

Figure 6:
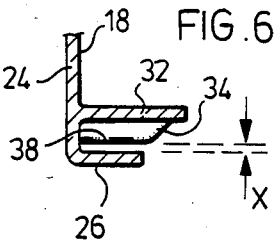
FIG. 6 is a section along the line 6—6 of FIG. 1.

In the illustrated arrangement the bosses 34 extending from the outer wall 16 or joining wall 32 towards the inner wall 26 while leaving a clearance X between the free edge 38 of the bosses 34 and the adjacent face of the inner wall 26 (see FIG. 6).

Figure 4:
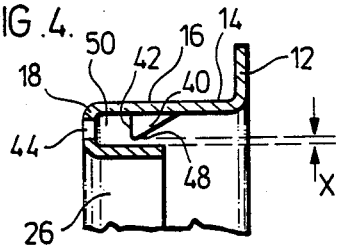
FIG. 4 is a section along the line 4—4 of FIG. 1.

At strategic locations generally at the 12:00, 5:00 3:00, 5:45, 6:15 and 9 o'clock positions around the opening 18 special abutment bosses 40 are provided. These abutment bosses 40 are formed substantially the same as the regular bosses 34 except they are shorter and are provided with an abutment face 42 substantially perpendicular to the inner wall 26 and facing the facing wall 18 (see FIG. 4).

Figure 5:
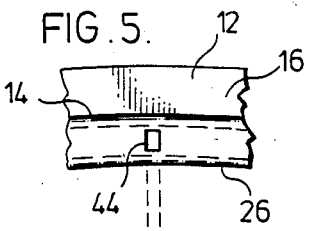
FIG. 5 is an end view looking from the left toward FIG. 4.

In order to form the abutment face 42 a removable bar is positioned in the mold during formation and this bar is removed after molding is complete by a withdrawal through the outer or facing wall 18 thereby leaving a hole such as the hole indicated at 44 (see FIGS. 1 and 5)

The edges 46 of the special abutments 40 closest to the inner wall 26 are spaced from the adjacent face of the inner wall 26 by a distance X equivalent to the distance X spacing for the edge 38 of the bosses 34. Each space 50 in the cavity 30 between the abutment faces 42 and the inside of the facing wall 18 (see FIG. 4) is designed to accommodate a suitable cooperating abutment on the wall to which the bearing is to be mounted as will be described in more detail hereinbelow.

FIG. 1 shows the end edges 52 and 54 of the arms 20 and 22 are spaced apart by a significant distance as formed in the molding operation by a knockout 56 extending between the edges 52 and 54 at the end of a pair of radial extensions 58 and 60 located at the ends 52 and 54 of the flange 12. This member 56 is broken away and removed when the bearing member 10 is to be mounted in position.

Figure 3:
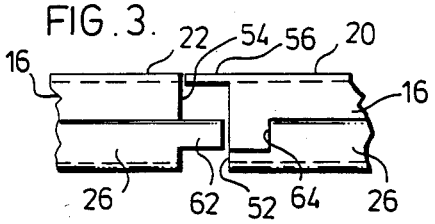
FIG. 3 is a view taken looking in the direction of the arrow 3 in FIG. 1.
Figure 3A:
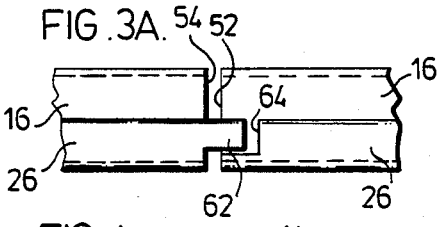
FIG. 3A is a view similar to FIG. 3 but showing the edges of the bearing moved into closer operative relationship.

Also formed at the end 54 of the arm 22 is a projection 62 which in operation is received within a blanked out section 64 at the end of the inner wall 26 on the arm 20 (see FIGS. 3 and 3A). This projection 62 and the cooperating cutout 64 permit overlap of the two arms at the inner face of the bearing member to provide a more pleasing looking joint where the two ends 52 and 54 come together and to permit relative movement between the two ends 52 and 54 to accommodate expansion of the bearing member in operation.

The bearing member 10 is adapted to be mounted on a front cabinet wall 66 particularly on a circumferential flange 68 extending around an access opening 70 through the wall 66. This flange 68 which extends substantially perpendicular to the wall 66 is formed with pressed out abutments 72 having faces 74 adapted and positioned to cooperate with the special abutments 40 as will be described hereinbelow. The faces 74 extend in a radial plane circumferentially of the opening 70, i.e., a fixed distance from the outer edge 76 of the flange which in the illustrated arrangement is also located in a radial plane (a plane perpendicular to the axis of the opening 70).

Attention is directed to FIGS. 10 and 11 which more clearly show the cooperation between the abutment 40, particularly the abutment face 42 with the abutment face 74 formed on the pressed out abutment 72 on the flange 68. Obviously the cooperation between all of the abutments 40 and 72 will be substantially the same and as seen in FIG. 10 the abutment 72 is received snugly within the cavity or space 50 with the outer edge 76 of the flange 68 substantially in contact with the inner surface of the facing wall 18 when the abutment faces 74 and 42 are in face to face relationship as shown in FIG. 10.

It will be apparent from FIG. 11 that the abutment 72 formed in the flange 68 is formed by a pressing operation and may be any suitable shape provided the circumferentially extending abutment surface 74 extends significantly longer in the circumferential direction than the narrow abutment face 42 on the abutment 40 so that movement of the abutments 40 due to expansion of the bearing member will not move the face 42 out of contact or beyond the edge of the face 74. Obviously the face 42 could be extended circumferentially and the face 74 made narrow or both faces 42 and 74 may extend for a substantial distance circumferentially to insure they remain in contact during relative changes in dimension of the bearing member 10 and the flange 68.

As shown in FIG. 9 the bearing member 10 is mounted in position and the translucent section 24 formed in the shape of a D, is in this particular case adapted to enclose a light and light fixture generally indicated at 78.

As illustrated also in FIG. 9 and in FIG. 1 the bearing member 10 may be provided with a pair of ears 80 which may be secured to the wall 66 by any suitable means such as screws or the like generally indicated at 82.

The projections 58 and 60 of the flange 12 adjacent the ends 52 and 54 are positioned between the duct work 83 and the inner surface of the wall 66 to aid in preventing axial movement of the mounting member 10 relative to the access opening 70 but permitting circumferential relative movement i.e., the projection 58 and 60 are trapped in a pocket (not shown) formed between the duct work 83 and wall 66.

It will be noted that the opening 28 or 70 is non-circular and yet the outer periphery of the bearing member 10 as defined by the bearing surface 14 is circular. It will further be noted that the arms 20 and 22 extend on the arc of a circle as defined by the flange 68 in the area wherein the flange 68 is received within the cavity 30 on these arms 20 and 22 so that the access opening 28 is thus over a major portion of its circumference circular and is truncated in effect by the cord formed by the straight portion 84 of the inner wall 26 (see FIGS. 1 and 9)

In operation with the bearing member mounted on the flange 68 of the wall 66 the mouth of the drier drum 100 (see FIG. 2) receives the outer periphery or outer wall 16 of the bearing member 10 which functions as a bearing to cooperate with the rim at the mouth of the drum thereby to support the drum. The break in the bearing member and space provided between the two end edges 52 and 54 permits circumferential expansion of the bearing member relative to the flange 68 and the abutment edges 74 similarly permit relative expansion while maintaining contact with the abutment edges 42 of the abutments 40. As above indicated the distance X between the edges 38 and 48 and the opposite wall 26 is substantially equal to the thickness of the flange 68 to prevent radial relative movement between the flange 68 and the member 10.

Figure 2:
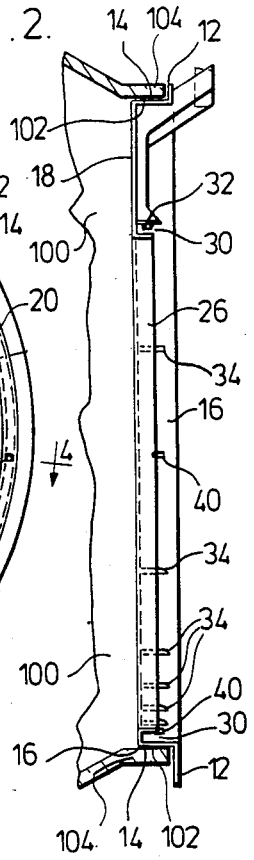
FIG. 2 is a section along the lines 2—2 of FIG. 1.

In order to schematically illustrate the arrangement of the drier drum on the bearing 10 a drier drum 100 has been shown schematically in FIG. 2. The drum 100 has a bearing surface 102 formed on the inner surface of the peripheral rim 104 of the access opening into the drier drum. It will be noted that the inner surface 102 lies in close proximity to the bearing surface 14 of the outer wall 16 to provide a bearing support for the drier drum 100.

It will be apparent that the bearing surface 14 cooperates with the surface 102 over substantially 360° thus the orientation of the cabinet does not materially affect the support of the drum 100 by the cooperation between the bearing surfaces 14 and 102.

Having described the invention modifications will be evident to those skilled in the art without departing from the spirit of the invention as defined in the appended claims.

What I claim as new and desire to secure by Letters Patent of the United States is:

1. A drier drum bearing member comprising an outer substantially right cylindrical outer wall, the outer surface of which is adapted to form a bearing to be received in an access opening in a drier drum to form a bearing for the drum, an inner wall extending coaxially with and positioned radially inward of said right cylindrical wall substantially parallel to the outer wall and defining a non-circular access opening through said bearing member, a facing wall interconnecting said inner and outer walls, said inner wall being positioned immediately adjacent said outer wall over a major portion of the periphery of said access opening to provide a first portion of a mounting cavity between said inner and outer walls, a joining wall substantially parallel to said inner wall and combining with said inner wall to form a second portion of said cavity, said first and second portions combining to extending substantially 360° around the periphery of said access opening, spaced bosses extending from a wall of said cavity toward an opposite wall of said cavity, at least some of said bosses having abutment edges substantially perpendicular to said inner and outer walls and spaced from said facing wall to provide a free space between said abutment edge and said facing wall adapted to receive a mating structure therebetween.

2. A bearing structure as defined in claim 1 wherein said inner, outer and facing walls terminate in said first portion of said cavity to provide spaced edges of said walls spaced sufficiently circumferentially of said opening to accommodate thermal expansion of said bearing member.

3. A bearing member as defined in claim 2 wherein said facing wall between said joining wall and said outer wall defines cavity in which a light fixture may be mounted.

4. A bearing member as defined in claim 2 wherein said bosses extend from said outer and joining walls toward said inner wall.

5. A drier structure including a cabinet wall adapted to mount a drier drum and a drier drum bearing member, an access opening through said wall, said access opening having a shape with a circular portion, said circular portion forming the major portion of a circle, a flange extending substantially perpendicular to said wall and defining the periphery of said access opening, said drum having a circular access opening, a molded bearing member mounted on said flange, said bearing member having an outer peripheral bearing wall and an inner peripheral wall interconnected by a facing wall, said inner peripheral wall being substantially parallel to said outer wall, said inner wall being shaped to conform with said access opening, said outer wall being spaced from said inner wall over that portion of said inner wall that conforms with said circular portion of said flange to provide a first portion of a narrow cavity into which said flange is telescopingly received, a joining wall in close proximity to and substantially parallel to said inner wall to define with said inner wall a second portion of said cavity, said first and second portions forming said narrow cavity extending substantially completely around said access opening and into which said flange is telescopingly received, spaced bosses extending from a face of one of said walls forming said cavity toward an opposite wall to snugly receive said flange between said bosses and said opposite wall, at least some of said bosses having abutment edges substantially perpendicular to said inner wall, abutment means formed on said flange adapted to cooperate with said abutment edges to limit axial movement of said bearing member and said flange while permitting circumferential relative movement of said bearing member and said flange about said access opening.

6. A drier as defined in claim 5 wherein said abutments project into said cavity from said outer wall and said joining wall.

7. A drier as defined in claim 6 wherein said facing wall between said outer wall and said joining wall is semi-transparent and provides a cavity for receiving a light.

8. A drier as defined in claim 5 wherein said walls forming said cavity are terminated at a location remote from said joining wall to form spaced ends spaced circumferentially of said access opening sufficiently to permit expansion of said bearing member relative to said flange in a direction circumferentially of said access opening.

9. A drier as defined in claim 8 wherein said outer wall has extending therefrom a radially extending circumferential flange and wherein portions of said flange adjacent said spaced ends are received between a cooperating member and said cabinet wall to retain said bearing member in position while permitting circumferential relative movement between said member and said flange.

* * * * *